United States Patent [19]

Scott

[11] Patent Number: 4,534,298

[45] Date of Patent: Aug. 13, 1985

[54] LOCK AND SEAL FOR HOPPER OUTLET

[75] Inventor: Mark P. Scott, Boiling Springs, Pa.

[73] Assignee: Keystone Industries, Inc., Rolling Meadows, Ill.

[21] Appl. No.: 467,155

[22] Filed: Feb. 16, 1983

[51] Int. Cl.[3] ..... B61D 7/20; B61D 7/22

[52] U.S. Cl. ..... 105/282 R; 105/308 P

[58] Field of Search ..... 105/282 P, 282 R, 305, 105/308 R, 308 P; 222/153, 561; 292/282, 286, 287, 307 R, 307 A

[56] References Cited

U.S. PATENT DOCUMENTS

| | | | |
|---|---|---|---|
| 3,035,530 | 5/1962 | Meyers et al. | 105/308 P |
| 3,683,820 | 8/1972 | Floehr | 105/308 P X |
| 3,707,126 | 12/1972 | Nester | 105/308 P X |
| 4,099,468 | 7/1978 | Adler | 105/282 P |
| 4,256,042 | 3/1981 | Fischer | 105/282 P |
| 4,301,741 | 11/1981 | Chierici | 105/308 P |
| 4,450,773 | 5/1984 | Fritz et al. | 105/282 A |

*Primary Examiner*—Randolph A. Reese

*Attorney, Agent, or Firm*—Marshall, O'Toole, Gerstein, Murray & Bicknell

[57] ABSTRACT

This disclosure relates to a frame adapted to be attached to a hopper car, a door plate slidably mounted on the frame, and an automatically engageable lock mounted on the frame adjacent the door plate and operable to hold the door plate closed when engaged. The lock includes pivotably mounted parts including a latch. One of the parts, which may be the latch, has a seal hole therein, and this seal hole is aligned with another seal hole in the frame when the lock is engaged. The seal holes are spaced from an adjacent edge of the frame a distance which is related to the size of the seal band such that there is little slack in the seal when the parts are coupled together. Further, the parts are shaped to require a substantial turning movement of the latch before the lock is disengaged, and the latch is unable to turn this distance because of the small amount of slack in the seal. Consequently the lock is prevented from accidentally disengaging when the seal is in place.

4 Claims, 6 Drawing Figures

LOCK AND SEAL FOR HOPPER OUTLET

Hopper cars are well known and commonly used in the railroad industry to convey a variety of commodities, such a car including one or more hopper outlets on its underside and a sliding gate for each hopper outlet to control the discharge of the commodity. A common type of outlet includes a frame secured to the car around the discharge outlet, a door plate slidably mounted on the frame for horizontal movement between open and closed positions, and a manually operated mechanism for moving the door plate. Such a gate usually also includes a manually operable lock for holding the door plate in its closed position.

A problem frequently arises with such a construction when a trainman neglects to close the door plate and engage the lock after emptying the car. Subsequent movement of the car, as during switching, results in the door plate shifting back and forth on the frame, and such shifting can be violent enough to damage parts of the mechanism or result in loss of the door plate.

The Nester U.S. Pat. No. 3,707,126, dated Dec. 26, 1972, and the Meyers et al. U.S. Pat. No. 3,035,530, dated May 22, 1962, disclose locks for such a door plate, which are designed to be automatically engaged. The Nester lock is tripped when the door plate is moved to the open position and becomes automatically engaged when the door plate is closed. The Meyers et al. lock is tripped when the door plate is moved to the closed position and becomes automatically engaged when the door reaches the fully closed position.

The hopper outlets shown in the foregoing patents, as well as other types of outlets having a lock, further include accommodation for a seal. Normally a hole is formed in a part that turns with the lock, and when the lock is engaged this hole is aligned with another hole formed in an adjacent nonrotating part. When the door plate is closed and the lock is engaged, a seal is threaded through the holes and latched, the intention being that the hopper lock may not be disengaged without first breaking the seal.

Such seals include a thin flexible band which extends through the holes. It has been found that in at least some constructions the band is sufficiently flexible and long that the hopper lock may become partially or entirely disengaged without the seal being broken. This may occur accidently when the car is jarred during switching, for example. Even if the prior art lock is moved a small amount, it may enable the door plate to partially open and spill granular material from the car.

It is a general object of this invention to provide an improved mechanism which avoids the foregoing problems.

Apparatus in accordance with the present invention comprises a frame adapted to be attached to a hopper car, a door plate slidably mounted on the frame, and an automatically engageable lock mounted on the frame adjacent the door plate and operable to hold the door plate closed when engaged. The lock includes pivotably mounted parts including a latch. One of the parts, which may be the latch, has a seal hole therein, and this seal hole is aligned with another seal hole in the frame when the lock is engaged. The seal holes are spaced from an adjacent edge of the frame a distance which is related to the size of the seal band such that there is little slack in the seal when the parts are coupled together. Further, the parts are shaped to require a substantial turning movement of the latch before the lock is disengaged, and the latch is unable to turn this distance because of the small amount of slack in the seal. Consequently the lock is prevented from accidentally disengaging when the seal is in place.

Other objects and advantages of the invention will become further apparent from the following detailed description taken in conjunction with the accompanying figures of the drawings, in which.

Figure 1:
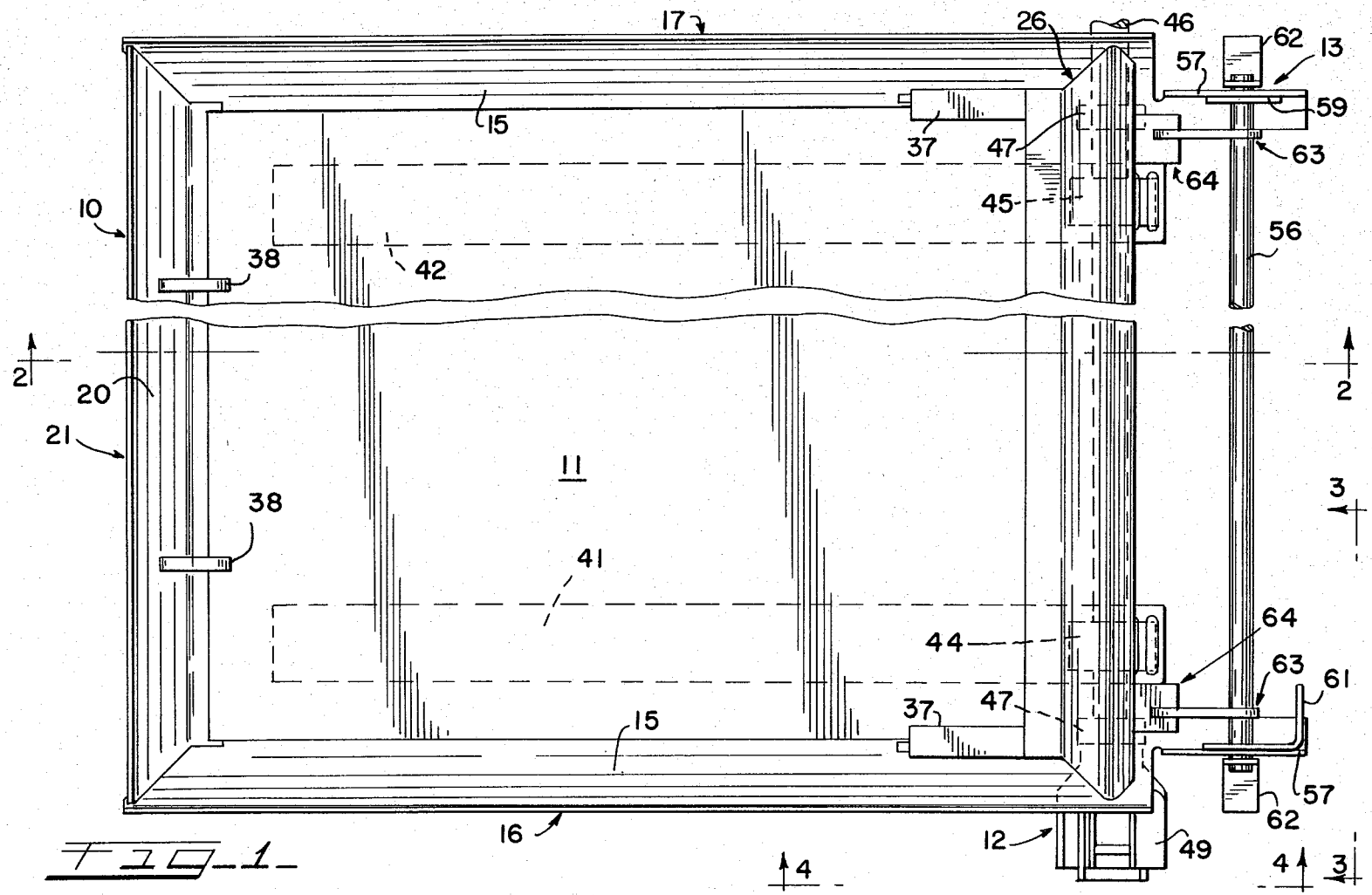
FIG. 1 is a fragmentary plan view of a hopper outlet embodying the present invention.
Figures 2, 3, 4, 5, 6:
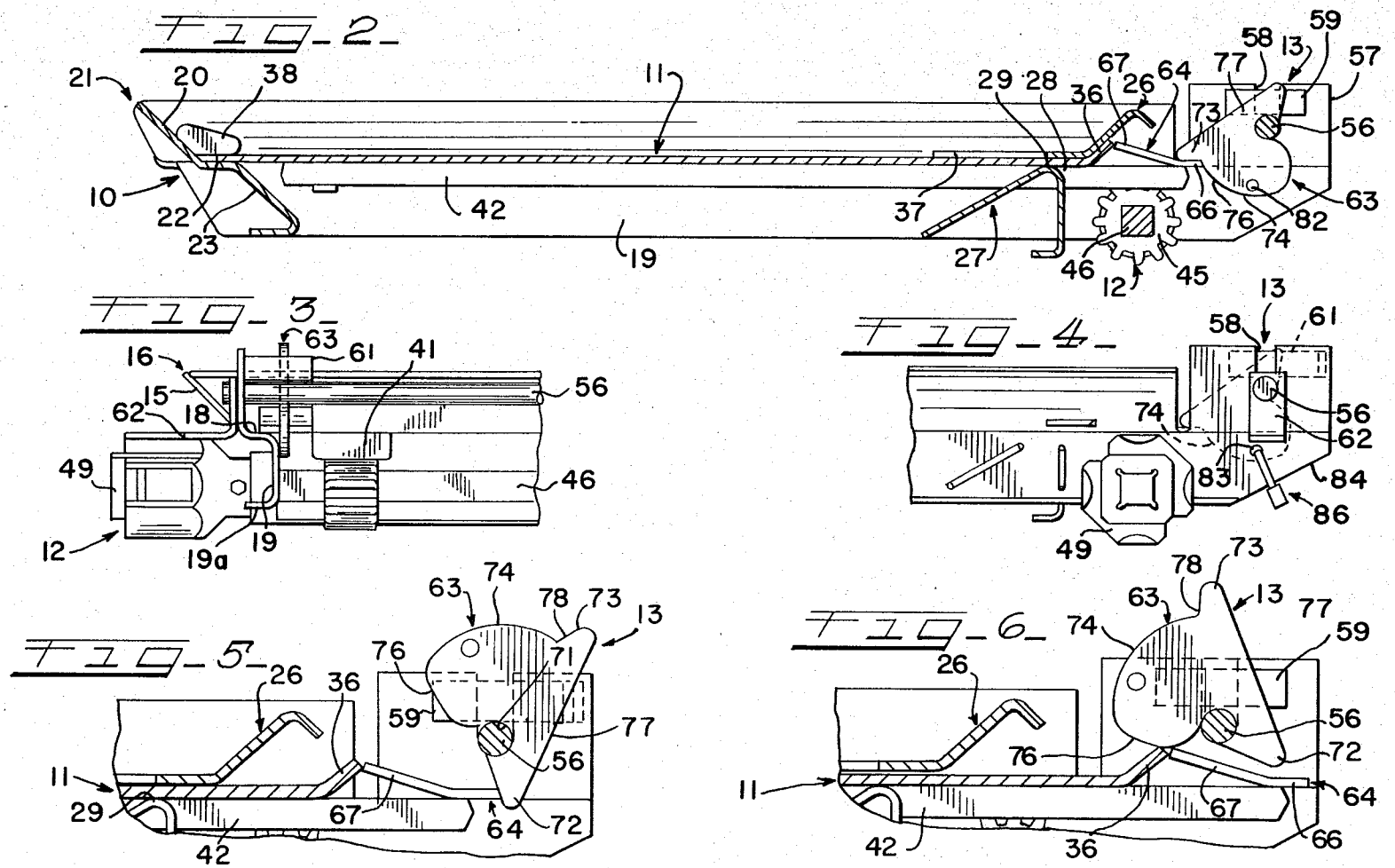
FIG. 2 is a sectional view taken on the line 2—2 of FIG. 1.
FIG. 3 is a fragmentary enlarged view taken on the line 3—3 of FIG. 1.
FIG. 4 is a fragmentary enlarged view taken on the line 4—4 of FIG. 1.
FIGS. 5 and 6 are enlarged fragmentary sectional views showing different positions of a latch of the apparatus.

With specific reference to the drawings, FIGS. 1 and 2 show a hopper outlet adapted to be attached to a hopper car. The outlet comprises a generally square frame 10, a door plate 11 mounted on the frame 10 for sliding movement in a generally horizontal plane, a manually operated gear mechanism 12 for moving the plate 11 between open and closed positions, and a lock 13 for holding the door plate 11 in its closed position. The frame 10 fits around the lower end of the hopper opening and is open at its center, and the door plate 11, when in its closed position shown in the drawings, closes the opening of the frame. The gear mechanism 12 is manually operated to move the door plate 11 toward the right, as seen in FIG. 2, to uncover the center opening of the frame 10 when the contents of the hopper car are to be discharged. The lock 13, when engaged, holds the door plate in its closed position.

The frame 10 comprises a pair of spaced-apart side plates 16 and 17 which, when the outlet is installed on a hopper car, extend longitudinally of the length of the car and are fastened to the walls (not shown) forming the hopper. As shown in FIGS. 1 and 3, each side plate 16 and 17 includes a portion 15 that slants downwardly and inwardly from its upper edge, the upper slanting portion of each plate being secured as by welding to the outside of a hopper wall. At the lower end of the slanting portion 15, each side plate is bent to extend generally horizontally and thus form a ledge 18, and then extends straight downwardly to form a wall 19 of the discharge opening or chute of the gate. The lower end of each side plate is bent laterally outwardly, as at **19*a* (FIG. 3**), in order to strengthen the side plate.

At its forward end, the frame includes a front plate 21 (FIGS. 1 and 2), the upper portion 20 thereof also slanting and being secured to the outside of a hopper wall. The front plate 21 is also bent inwardly to form a generally horizontally extending ledge 22 at the same level as the ledges 18 of the side plates 16 and 17. The lower portion of the front plate 21 slants downwardly and inwardly to form another wall 23 of the discharge opening of the gate. The front plate 21 is secured to the two side plates 16 and 17 and to the hopper wall, as by welding, which process may also be used to secure other parts of the frame together.

The back or rearward side of the frame includes a rear upper plate 26 and a rear lower plate 27, the upper plate 26 slanting downwardly and inwardly and being secured to the outside of another wall of the hopper.

The lower plate 27 also slants downwardly and inwardly and forms the fourth wall of the discharge opening of the gate. The two plates 26 and 27 are vertically separated, thus forming a space 28 therebetween through which the door plate moves. The upper end portion of the lower plate 27 is bent over and downwardly to form a ledge 29 which is also at the level of the ledges 18 and 22 of the side and front plates.

The door plate 11, when in its closed position as shown in FIGS. 1 and 2, is supported at its edges by the ledges 18, 22 and 29. The rearward end portion of the door plate 11 extends through the space 28 between the upper and lower plates 26 and 27 and is bent upwardly, as indicated at 36 in FIG. 2. A pair of guide plates or bars 37 (FIG. 2) are secured to the two side plates 16 and 17 above the ledges 18, and the side edges of the door plate 11 extend into the spaces between the ledges 18 and the guides 37. A plurality of hold-down lugs 38 are secured to the front plate 21 above the ledge 22, and the forward end portion of the door plate 11 fits snugly in the space between the ledge 22 and the lugs 38 when the door plate is fully closed. Thus, the door plate 11 is slidably supported on the ledges 18, 22 and 29, and it may be moved toward the right from the closed position shown in FIG. 2 to its open position where the discharge opening of the gate is uncovered. The two guides 37 prevent the door plate 11 from tipping in the clockwise direction, as viewed in FIG. 2, when it is entirely open.

The gear mechanism 12 for moving the door plate 11 between its open and closed positions includes two racks 41 and 42 (FIGS. 1 to 3) secured to the underside of the door plate 11 adjacent the side edges thereof and extending longitudinally in the direction of movement of the door plate 11. With reference to FIGS. 2 and 3, portions at the ends of the lower plate 27 are cut away to provide clearance for the racks 41 and 42. The two racks 41 and 42 project rearwardly from the plate 11 and overlie two spur gears 44 and 45, and teeth on the undersides of the racks mesh with the spur gears 44 and 45. The gears 44 and 45 are secured to a laterally extending operating shaft 46 below the level of the plate 11, the operating shaft 46 being rotatably supported on bearings 47 fastened to rearwardly extending end portions of the two side plates 16 and 17 of the frame. Thus, turning of the operating shaft 46 results in turning movement of the two spur gears 44 and 45 and movement of the racks and the door plate in one direction or the other, depending of course on the direction of rotation of the shaft 46. To enable the operating shaft 46 to be turned, a socket 49 is secured to each end thereof. Each socket 49 is shaped so that a trainman may insert a bar into the socket in order to turn the shaft 46.

The lock 13 comprises a latch rod 56 which extends laterally between the two side plates 16 and 17. The rod 56 extends transversely or normal to the direction of movement of the plate 11 and is above the path of movement of the door plate 11, as shown in FIG. 2. As is best shown in FIGS. 1, 2 and 3, the two side plates 16 and 17 extend rearwardly from the rear plate 26 and the shaft 46, and the rearward end sections 57 of the upper portions 15 of the two side plates 16 and 17 extend substantially vertically. Vertically extending notches or slots 58 (FIGS. 2 and 4) extend downwardly from the upper edges of the sections 57, and the latch rod 56 is rotatably supported at the bottoms of the two notches. At side plate 17, the rod 56 is retained in the slot 58 by a short retainer bar 59 that is positioned above the rod 56 and welded to the section 57. At the side plate 16, a right-angled retainer-stop 61 (FIGS. 1 and 3) is secured to the associated section 57 above the rod 56. The rod 56 extends laterally outside the sections 57 and a handle 62 (FIGS. 1, 3 and 4) is secured to each end of the rod. The handles 62 have a right-angle shape and are located on the rod 56 to hang downwardly from the rod 56 as shown in FIGS. 1 and 4 when the lock is engaged. The handles 62 also, of course, serve to prevent the rod 56 from moving out of the slots 58.

Adjacent the ends of the rod 56 are secured, as by welding, latches 63 which are identical and function similarly. The two latches are rotatable between a stable locked or engaged position (FIGS. 1–4), a stable unlocked or disengaged position (FIG. 5), and a tripped position (FIG. 6). The latches 63 are engageable with ramps 64 (FIGS. 1, 2, 5 and 6) secured to the rearward edge of the door plate 11. As best shown in FIGS. 1 and 3, each ramp 64 is positioned between the adjacent rack and side plate and secured to the rack as by welding. Each ramp 64 includes a generally horizontal portion 66 that is approximately at the level of the upper surface of the racks, and an inclined portion 67 that slopes upwardly and forwardly to the upper edge of the edge 36 of the plate 11. As shown in the drawings, the latches 63 and the ramps 64 are located closely adjacent the side plates 15 and 16.

Each of the latches 63 is shaped from a flat piece of metal. A circular recess 71 receives the rod 56 and they are rigidly secured together, so that the latches rotate on the axis of the rod 56. When in the disengaged position (FIG. 5), a downwardly extending tail 72 of each latch is in the path of the rearward edge of the associated ramp 64, and the rearward edge of one of the latches rests against the stop 61. When in the engaged position, the latches bear against the rearward edges of the ramps 64 and lips 73 rest on the upper surfaces of the ramps. With reference to FIG. 2 which shows the engaged position, the major portions of the latches 63 are to the left of the axis of the rod 56, and the handles 62 extend substantially downwardly, and consequently the center of gravity of the lock is to the left of the rod axis and tends to hold the latches in the engaged position. The latches 63 are rotated approximately 170° in the clockwise direction when moved from the engaged to the disengaged position shown in FIG. 5, and in the latter position the center of gravity is slightly to the right of the rod axis, as seen in FIG. 5. Consequently, the lock tends to remain in the disengaged position, against the stop 61.

With reference to FIGS. 2, 5 and 6, each latch 63 includes a curved edge portion 74 which is essentially an arc having its center at the axis of the rod 56. The curved portion 74 of each latch extends through approximately an 80° arc in the counterclockwise direction from the lip 73. From the curved portion 74, the outer edge of each latch extends substantially radially inwardly along a flat portion 76 to the recess 71. The remaining side 77 extends straight between the tail 72 and the lip 73, but it may have a different shape so long as the location of the center of gravity relative to the rod 56 remains as described. At the juncture of the curved edge portion 74 and the lip 73 of each latch is formed a notch 78 which engages the rearward end edge of the associated ramp when the lock is engaged.

When the door plate 11 is in the closed position, the lock is manually engaged by turning one of the handles 62 to swing the latches 63 to the FIG. 2 position where the lips 73 rest on the upper surfaces of the ramps 64 and the rear ends of the ramps extend into the notches 78. Since the line of movement of the plate 11 is below the rod 56, any tendency of the plate 11 to move toward the right as seen in FIG. 2 will cause the latches 63 to tend to swing in the counterclockwise direction. Thus the lock will become more tightly engaged by opening movement of the plate.

The lock is moved to the disengaged position (FIG. 5) by manually turning one of the handles 62 to move the edge 77 against the stop 61. In this position the tails extend downwardly into the path of the door plate 11 and the ramp 64. Consequently, movement of the door plate 11 toward the open position results in the ramps 64 striking the tails 72 and rotating the latches 63 to the tripped or intermediate position shown in FIG. 6.

Immediately upon being moved to the tripped position, the flat portions of the latches rest on the upper surfaces of the ramps 64. Movement of the door plate 11 toward the right results in the surfaces 76 riding up the sloped part 67 of the ramps 64 and then down the slanted rear edge 36 of the plate 11. The lock pivots on the axis of the rod 56 during this movement but the center of gravity of the lock remains to the left of the rod axis. Once the edge 36 has moved past the latches, the latches ride on the upper surface of the plate 11. It should be noted that the latches 63 are rounded at the ends of the flat part 76 so as to remove the danger of the plate 11 catching on the latches. When the plate 11 slides to the closed position the parts 76 of the latches again ride over the slanted surfaces of the parts 67 and 36.

When a hopper car including a discharge gate of the foregoing character is to be loaded, the door plate 11 is first moved to its closed position and the lock 13 is turned to engage the latches 63 with the ramps 64 (FIGS. 1, 2 and 4). The discharge outlet is sealed by threading a wire or band seal 86 through holes 82 and 83 (FIGS. 2 and 4) formed in one of the latches 63 and the adjacent side plate of the outlet frame 10. The seal holes are aligned only when the lock is fully engaged. As best shown in FIG. 4, the holes 82 and 83 are located relative to the length of the band of the seal 81 so that the distance of the holes from the closest edge 84 of the side plate requires that substantially all of the slack must be drawn out of the seal band. In other words, the distance of the holes 82 and 83 from the closest edge 84 is only slightly less than one-half the length of the seal band. This distance may be closely controlled during manufacture by punching the edge 84 and the hole 83 in the side frame. As a specific example, the distance of the hole 83 to the edge 84 may be approximately 1-½ inches for use with a standard sized seal.

To discharge the contents of the hopper car, the seal 81 is removed and, by turning one of the two handles 62, the latches 63 are pivoted clockwise to their fully disengaged position, as shown in FIG. 5. A bar (not shown) is inserted into one of the openings in a socket 49, and the operating shaft 46 is turned to move the door plate 11 toward its open position. Movement of the door plate toward the open position causes the rearward ends of the two ramps to strike the tails 72 of the two latches 63 and pivot the latches 63 to the tripped position, shown in FIG. 6. Subsequent movement of the door plate 11 to the closed position results in the two latches 63 dropping into their fully engaged positions. Even if the door plate 11 were moved to its fully closed position and the latches were left in the disengaged position, the latches would automatically be tripped by shifting of the door plate 11 when the hopper car is moved, as during switching. For example, sharp movement of the car toward the left, as seen in FIG. 2, would cause the door plate 11 to shift toward the right and trip the latches. Subsequent slowdown of the car would cause the door plate 11 to shift to the left, and the latches would then immediately drop into the engaged position and prevent further movement of the door plate 11.

With reference to FIGS. 2 and 4, the relatively large arcuate edge 74 of each latch 63 requires that the latches must be pivoted through a relatively large angle before they will disengage from the ramps 64. In the present case, the angle is approximately 70°–80°. With the seal 81 in place, the latches cannot approach this amount of movement, and therefore the lock cannot accidentally disengage. Even if a seal is not in place and the car is subjected to severe jarring, it is unlikely that the latches will accidentally swing through so large an angle.

The combined weights of the latches and the handles, of course, retard such movement.

The curved parts 74 of the latches may be shaped so that they bulge outwardly slightly between the notch 78 and the straight part 76. In other words, the radius of the center area of the curve 74 may be slightly greater than at the ends of the curve 74, which would make opening movement of the lock more difficult because the edge 74 would tend to scrape against the adjacent edge of the ramp.

Another advantage of the present construction is that the dimensions of the lock may be closely controlled. The critical location of the notch 78 and the curved surface 74 of the latches relative to the ramp 64 is accurately met because the location and depth of the slots 58, may be stamped from the side plates. A final adjustment of the distances may easily be made by grinding the rear ends of the ramps.

Still another advantage arises from the closeness of the latches 63 to the side plates of the frame, which produces relatively little twisting or bending force on the rod 56 due to pressure of the door plate 11 on the latches 63.

I claim:

1. A discharge outlet and lock for a hopper car, comprising a side frame adapted to be secured to the car, a door plate slidably supported on said side frame for movement between an open position and a closed position, a lock comprising a rod rotatably supported on said side frame adjacent to and above the path of movement of said plate, at least one latch secured to said rod and rotatable with said rod between an engaged position, a disengaged position and a tripped position, said latch including a first portion which when in said engaged position engages the door plate and holds the door plate in the closed position, said latch further including a second portion which when in said disengaged position extends in the path of movement of the door plate, said second portion being located to be struck by said door plate upon movement of said door plate toward the open position and to be thereby moved to said tripped position, said latch when in said tripped position resting on said door plate and being in position for subsequent automatic movement to said engaged position upon return of said door plate to its closed position, said latch being mounted on said rod closely adjacent said side frame, a first seal hole formed in said latch, a second seal hole formed in said side frame, and said first and second seal holes being generally aligned when said latch is in said engaged position, said side frame having outer edges and said second seal hole being spaced from the nearest portion of said outer edge, said seal holes being adapted to receive a seal band, said seal holes being located relative to said nearest portion of said outer edge such that said first seal hole of said latch moves away from said nearest portion of said outer edge and tensions the seal band when said latch is initially moved from said engaged position toward said disengaged position, and said spacing being related to the length of the seal band to result in removal of slack from the band when the seal is connected around said nearest portion of said outer edge.

2. Apparatus according to claim 1, wherein said latch further includes a third portion between said first and second portions, said third portion extending over a substantial arc whose center is approximately on the axis of said rod.

3. Apparatus according to claim 2, wherein said third portion extends over an arc of approximately 80°.

4. Apparatus according to claim 1, and further including a ramp secured to said plate, said latch engaging said ramp when in said engaged position and said door plate is in said closed position.

* * * * *